US007481082B2

(12) United States Patent
Cho et al.

(10) Patent No.: US 7,481,082 B2
(45) Date of Patent: Jan. 27, 2009

(54) DETERGENT SUPPLY APPARATUS OF WASHING MACHINE

(75) Inventors: Han Ki Cho, Changwon-si (KR); Yang Hwan No, Changwon-si (KR); Jung Hoon Kang, Changwon-si (KR); Jong Min Kim, Changwon-si (KR); Ho Sung Jang, Kyungsangnam-do (KR); Dong Hoon Kang, Pusan (KR)

(73) Assignee: LG Electronics Inc., Seoul (KR)

( * ) Notice: Subject to any disclaimer, the term of this patent is extended or adjusted under 35 U.S.C. 154(b) by 401 days.

(21) Appl. No.: 11/104,639

(22) Filed: Apr. 13, 2005

(65) Prior Publication Data

US 2005/0241347 A1 Nov. 3, 2005

(30) Foreign Application Priority Data

Apr. 14, 2004 (KR) ..... 10-2004-0025965

(51) Int. Cl.
*D06F 39/02* (2006.01)

(52) U.S. Cl. ..... 68/17 R; 68/207

(58) Field of Classification Search ..... 134/93, 134/99.2, 100.1, 200; 68/17 R, 207
See application file for complete search history.

(56) References Cited

U.S. PATENT DOCUMENTS

| | | | | |
|---|---|---|---|---|
| 5,687,590 | A * | 11/1997 | Borroni et al. | 68/17 R |
| 6,227,012 | B1 * | 5/2001 | Borroni et al. | 68/17 R |
| 6,826,933 | B2 * | 12/2004 | Merkle et al. | 68/17 R |
| 2003/0145633 | A1 | 8/2003 | Merkle et al. | |
| 2003/0172690 | A1 * | 9/2003 | Kim et al. | 68/17 R |
| 2004/0069325 | A1 * | 4/2004 | Cerruti et al. | 134/25.2 |
| 2004/0172770 | A1 * | 9/2004 | Heo et al. | 8/158 |
| 2005/0229652 | A1 * | 10/2005 | Kim et al. | 68/237 |

FOREIGN PATENT DOCUMENTS

| | | |
|---|---|---|
| DE | 34 04 247 A1 | 8/1985 |

* cited by examiner

*Primary Examiner*—Joseph L Perrin
(74) *Attorney, Agent, or Firm*—Birch, Stewart, Kolasch & Birch, LLP

(57) ABSTRACT

Disclosed herein is a detergent supply apparatus of a washing machine, which installs a liquid detergent container in a powdered detergent chamber of a detergent container. The liquid detergent container makes it possible to mix and supply liquid detergent and water, which allows liquid detergent to be conveniently placed in, moreover, decoloration and discoloration of laundry to be prevented.

15 Claims, 5 Drawing Sheets

DETERGENT SUPPLY APPARATUS OF WASHING MACHINE

BACKGROUND OF THE INVENTION

1. Field of the Invention

The present invention relates to a detergent supply apparatus of a washing machine, more particularly, which is capable of supplying liquid detergent and water to a tub of the washing machine.

2. Description of the Related Art

A washing machine is to decontaminate dirt on clothes or bedding (hereinafter referred as "laundry") contained in a drum. It cleans laundry through washing, rinsing, dehydrating and drying.

The washing machine has a detergent supply apparatus to supply powdered detergent or fabric softner mixed with water supplied.

The use of liquid detergent is increasingly so popular that it prevents a water supply passage of a detergent container from clogging due to powered detergent, besides, it brings more powerful washing effect.

However, the conventional detergent supply apparatus of the washing machine has no additional detergent chamber for liquid detergent but a powdered detergent chamber. Inevitably, liquid detergent is directly poured in and touched with laundry, which causes decoloration and discoloration of laundry.

SUMMARY OF THE INVENTION

Accordingly, it is an object of the present invention to provide a detergent supply apparatus of a washing machine, which supplies liquid detergent together with water and protects against decoloration and discoloration of laundry.

Another object of the present invention is to provide the detergent supply apparatus of the washing machine, which makes it possible to easily place powdered detergent or liquid detergent according to circumstances.

To achieve the above and other objects of the present invention, a detergent supply apparatus of a washing machine according to the present invention comprises a detergent container having a powdered detergent chamber which stores powdered detergent, and a liquid detergent container detachably set in the powdered detergent chamber, which stores liquid detergent.

The detergent container has a plurality of powdered detergent chambers, and the liquid detergent container is detachably set in each of the powdered detergent chambers.

The powdered detergent chamber is partitioned into a main detergent storing section for main washing and a preliminary detergent storing section for preliminary washing.

The liquid detergent container is furnished with a main liquid detergent container detachably set in the main detergent storing section and a subsidiary liquid detergent container detachably set in the preliminary detergent storing section.

The detergent container has a fabric softner storing section where fabric softner is accommodated and a siphon is protruded. A fabric softner cover covers the fabric softner storing section and provides a water drain passage with the siphon.

The detergent container has a bleach storing section where bleach is accommodated and a siphon is protruded. A bleach cover covers the bleach storing section and provides the water drain passage with the siphon.

A plurality of protrusions is existed in a bottom of the liquid detergent container, which makes apart its bottom from the corresponding area of the powdered detergent chamber by predetermined distance.

A plurality of protrusions is existed in a side of the liquid detergent container, which makes apart its side from the corresponding area of the powdered detergent chamber by predetermined distance.

Height of the liquid detergent container is lower than that of the powdered detergent chamber.

The liquid detergent container has a protruded siphon and a liquid detergent siphon cover which covers the siphon and provides the water drain passage together with the siphon.

The liquid detergent container has a downward sloping surface toward the siphon in a lower part.

The liquid detergent siphon cover has a straight portion which is suspended on a wall of the liquid detergent container so as to restrict its rotation.

The liquid detergent siphon cover has an indication portion in a stepwise manner, which shows the maximum quantity of liquid detergent.

The detergent supply apparatus of the washing machine according to the present invention comprises the detergent container having the powdered detergent chamber, and the liquid detergent container detachably set in the powdered detergent chamber.

The detergent supply apparatus of the washing machine according to the present invention comprises a housing installed in the washing machine, which is open at its front and top, the detergent container having the detergent chambers, which is inserted in the housing through a front of the housing, a dispenser having a plurality of water supply passages to inject water into the detergent chamber, which covers a top surface of the housing, and the liquid detergent container detachably set in the detergent chamber so as to mix and supply liquid detergent and water together.

The detergent container is partitioned into the detergent sections.

The detergent chambers include the main detergent storing section, the preliminary detergent storing section, the bleach storing section, and the fabric softner storing section.

The liquid detergent container has the protruded siphon and the liquid detergent siphon cover which covers the siphon and provides the water drain passage together with the siphon.

The washing machine according to the present invention comprises a cabinet, a tub mounted in the cabinet, a drum rotatably set in the tub, the housing installed in the cabinet, the detergent container having the powdered detergent chamber so as to mix and supply powdered detergent and water together, which is inserted into the housing, the dispenser having the water supply passage to inject water into the powdered detergent chamber, which covers the top surface of the housing, and the liquid detergent container detachably set in the powdered detergent chamber so as to mix and supply liquid detergent and water together.

According to the present invention, the liquid detergent container is installed in the powdered detergent chamber of the detergent container, which mixes and supplies liquid detergent and water together. Liquid detergent can be simply supplied. As liquid detergent diluted with water soaks laundry, decoloration and discoloration of laundry can be protected.

The liquid detergent container is detachably set in the powdered detergent chamber of the detergent container, on that account, liquid detergent or powdered detergent can be easily placed in depending on a user's intention The detergent container has the powdered chambers and the liquid detergent container is detachably set in each of the powdered detergent chambers, on that account, liquid detergent and powdered detergent can be used together.

The powdered detergent chamber is partitioned into the main detergent storing section and the preliminary detergent storing section. The liquid detergent container is replenished with the main liquid detergent container detachably set in the main detergent storing section and the subsidiary liquid detergent container detachably set in the preliminary detergent storing section. If either the main liquid detergent container or the subsidiary liquid detergent container is installed in the detergent container, a different type of detergent can be used in a main and preliminary washing process. The washing power can be much more improved.

The bottom of the liquid detergent container is parted from that of the powdered detergent storing section by predetermined distance, on that account, liquid detergent and water can easily flow without stagnating.

The side of the liquid detergent container is parted from that of the powdered detergent chamber by predetermined distance and a top of the liquid detergent container is lower than that of the powdered detergent chamber, on that account, liquid detergent and water does not overflow into another place. It can prevent the unnecessary use of detergent.

The liquid detergent container has the protruded siphon and the liquid detergent siphon cover which covers the siphon and provides the water drain passage together with the siphon, on that account, mixing and supplying liquid detergent and water is simply possible.

The lower part of the liquid detergent container has the downward sloping surface toward the siphon, on that account, remaining liquid detergent can be minimized.

The liquid detergent siphon cover has the straight portion which is suspended on the wall of the liquid detergent container in order to restrict its rotation, on that account, an additional structure, i.e. a hook, fixing the liquid detergent siphon cover is not required and noise from the vibration of the washing machine can be minimized.

The liquid detergent siphon cover has the indication portion in a stepwise manner, which shows the maximum quantity of liquid detergent, on that account, the user can easily notice the maximum quantity of liquid detergent. It can prevent the excessive use of liquid detergent and even the overflowing of liquid detergent.

BRIEF DESCRIPTION OF THE DRAWINGS

The above and other objects, features and advantages of the present invention will be more clearly understood by reference to the following detailed description taken in conjunction with the accompanying drawings, in which.

DETAILED DESCRIPTION OF THE PREFERRED EMBODIMENT

Now, the preferred embodiment of the present invention will be hereinafter described in detail with reference to the accompanying drawings.

Figure 1:
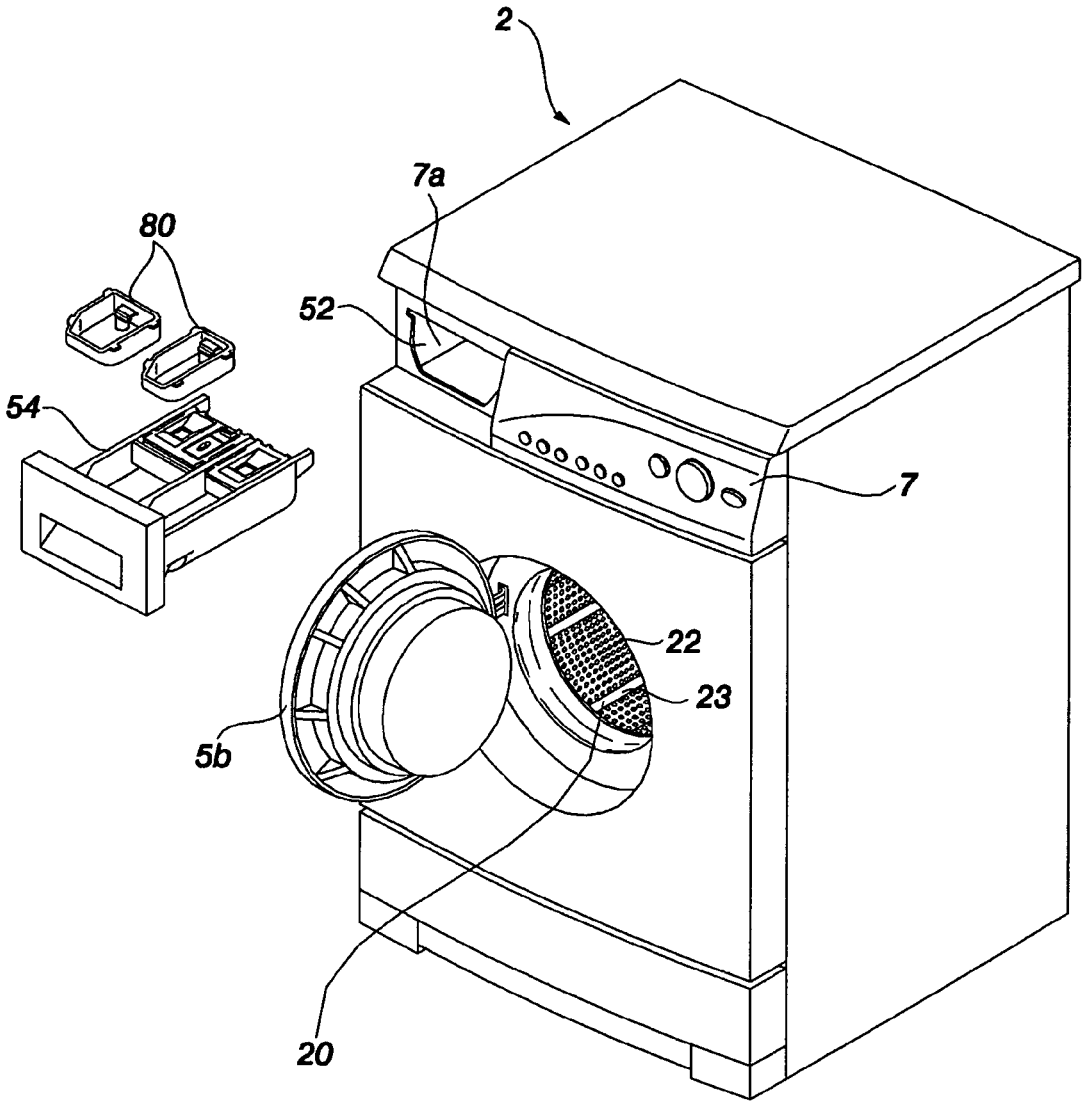
FIG. 1 is a perspective view of a detergent supply apparatus of a washing machine in accordance with an embodiment of the present invention.
Figure 2:
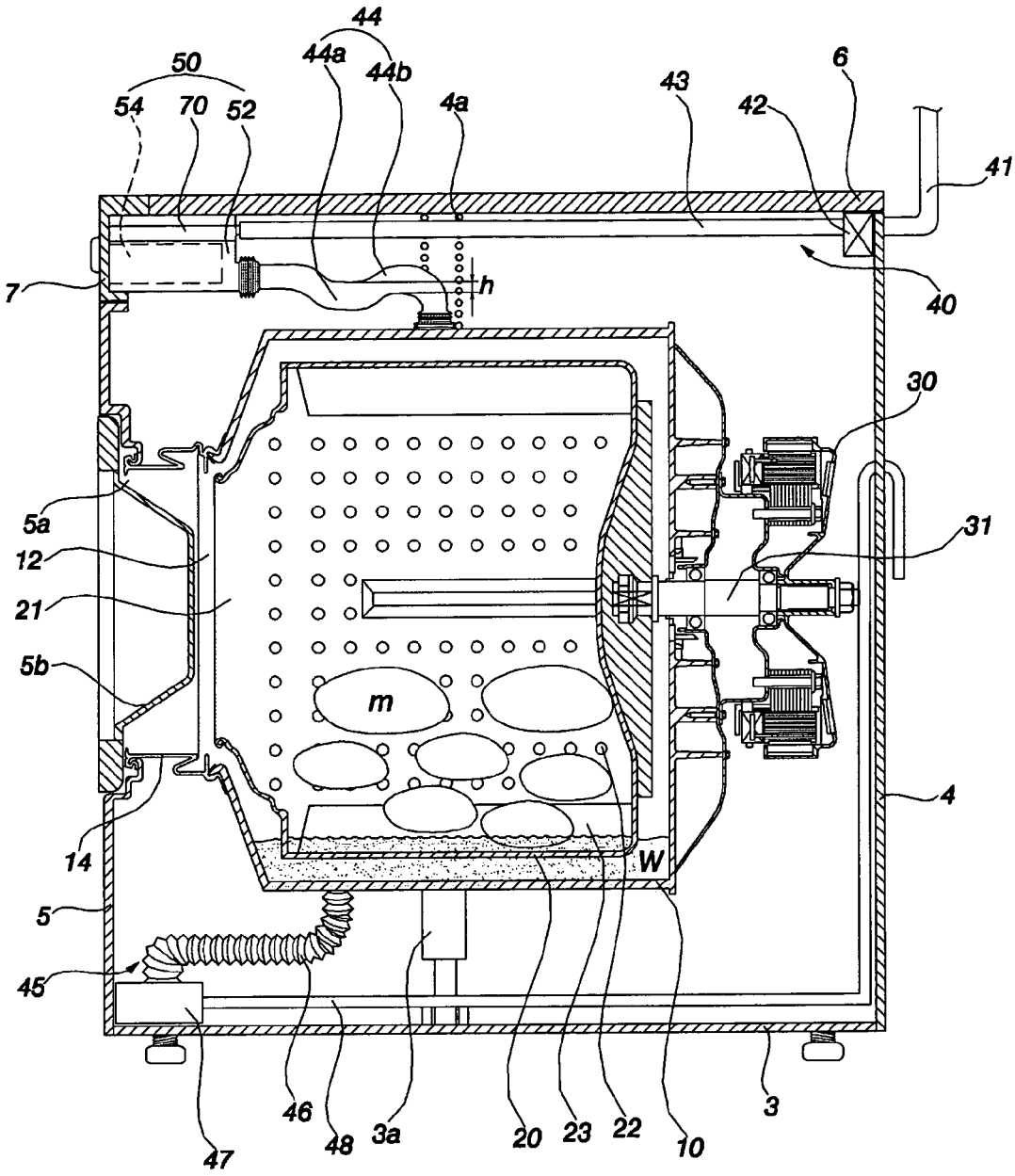
FIG. 2 is a schematic view of the detergent supply apparatus of the washing machine in accordance with an embodiment of the present invention.

FIG. 1 is a perspective view of a detergent supply apparatus of a washing machine in accordance with an embodiment of the present invention, and FIG. 2 is a schematic view of the detergent supply apparatus of the washing machine in accordance with an embodiment of the present invention As shown in FIGS. 1 and 2, the washing machine according to the embodiment comprises a casing 2, a tub 10 suspended in a casing 2 by a shock absorber to contain water with detergent or clean water (w, hereinafter referred as "washing water"), a drum 20 rotatably set in the tub 10 to receive laundry(m), a driving motor 30 which makes the drum 20 rotate, a water supplier 40 which supplies water to the tub 10, a water drainer 45 which drains contaminated water in the tub 10 or dehydrated water from laundry(m) out of the washing machine, and the detergent supply apparatus 50 connected to the water supplier 40 in order to mix detergent in water from the water supplier 40.

The casing 2 comprises a base 3 having a damper 3*a* to uphold the tub 10, a cabinet 4 having a spring 4*a* in both sides to hang the tub 10, which is located in a top of the base 3 to surround both sides and a rear of the tub 10, a cabinet cover 5 having an entrance hole 5*a* in a middle to place and remove laundry(m) and a door 5*b* to open and close the entrance hole 5*a*, which is located in a front of the cabinet 4, and a top plate 6 which covers a top surface of the cabinet 4.

A control panel 7 is installed in an upper part of the cabinet cover 5 in order to manipulate the washing machine.

The control panel 7 has an entrance hole for a detergent container 7*a* which will be mentioned later.

An opening 12 is formed on a front of the tub 10 to allow laundry(m) to put in and out from the drum 20, and a gasket 14 is mounted around the opening 12 to prevent water from leaking and laundry(m) from separating by closely adhering to a rear surface of the door 5*b*.

The drum 20 has an entrance hole 21 for placing and removing laundry(m) in the front of the tub 10. A plurality of perforations 22 for going in and out washing water is existed in a circumference or the rear of the tub 10. A lifter 23 for moving upward and dropping laundry(m) is installed in an inner circumference of the tub 10. A bottom of the drum 20 is submerged in washing water(w) in the tub 10.

The driving motor 30 is set in a rear surface of the tub 10 and connected to a rear surface of the drum 20, as a shaft 31 which penetrates the rear of the tub 10 is supported by a bearing of the tub 10.

The water supplier 40 connected to an external hose 41, referring to FIG. 2, comprises a water supply valve 42 to control water supplied through the external hose 41, a plurality of water supply hoses 43 to guide water through the water supply valve 42 to the detergent supply apparatus 50, and a water supply bellows tube 44 to guide washing water through the detergent supply apparatus 50 to the inside of the tub 10.

The water supply valve 42 includes 3 cold water valves and 1 hot water valve.

The water supply hose 43 includes 3 cold water hoses and 1 hot water hose.

Though air within a housing 52 which will be mentioned later may move to the tub 10 through the water supply bellows tube 44, steam flowing backward from the tub 10 as drying or heating washing is condensed by water contained in the water supply bellow tube 44.

The water supply bellows tube 44 has a $1^{st}$ bending portion 44*a* in the shape of ∪ and a $2^{nd}$ bending portion 44*b* in the shape of ∩, on one side. Water is sank to a bottom of an inner horizontal portion in the $1^{st}$ bending portion 44*a*, and a top of the horizontal portion in the $1^{st}$ bending portion 44*a* is placed higher than a bottom of the horizontal portion in the $2^{nd}$ bending portion 44*b* by predetermined height (h). An air passage is made in the top of the inner horizontal portion in the $1^{st}$ bending portion 44*a* and in the inner horizontal portion in the $2^{nd}$ bending portion 44*b*.

The water drainer 45 comprises a water drain bellows tube 46 connected to an overflow of the tub 10 in order to discharge washing water into the tub 10, a water drain pump 47 to pump water drained to the water drain bellows tube 46, and a water drain hose 48 to guide washing water pumped by the water drain pump 47 out of the washing machine.

As seen in FIGS. 1 and 2, the detergent supply apparatus 50 comprises the housing 52 placed in one end of the control panel 7 and connected to the water supply bellows tube 44, which is open at its front and top, a detergent container 54 installed in the housing 52 to move forward through a front of the housing 52, a cover 70 (hereinafter referred as "dispenser") to cover a top surface of the housing 52, installed in a top of the housing 52 and to supply water to the detergent container 54, connected to the water supply hose 43, and a liquid detergent container 80 detachably set in the detergent container 54 so as to mix and supply liquid detergent and water supplied to the detergent container 54.

Figure 3:
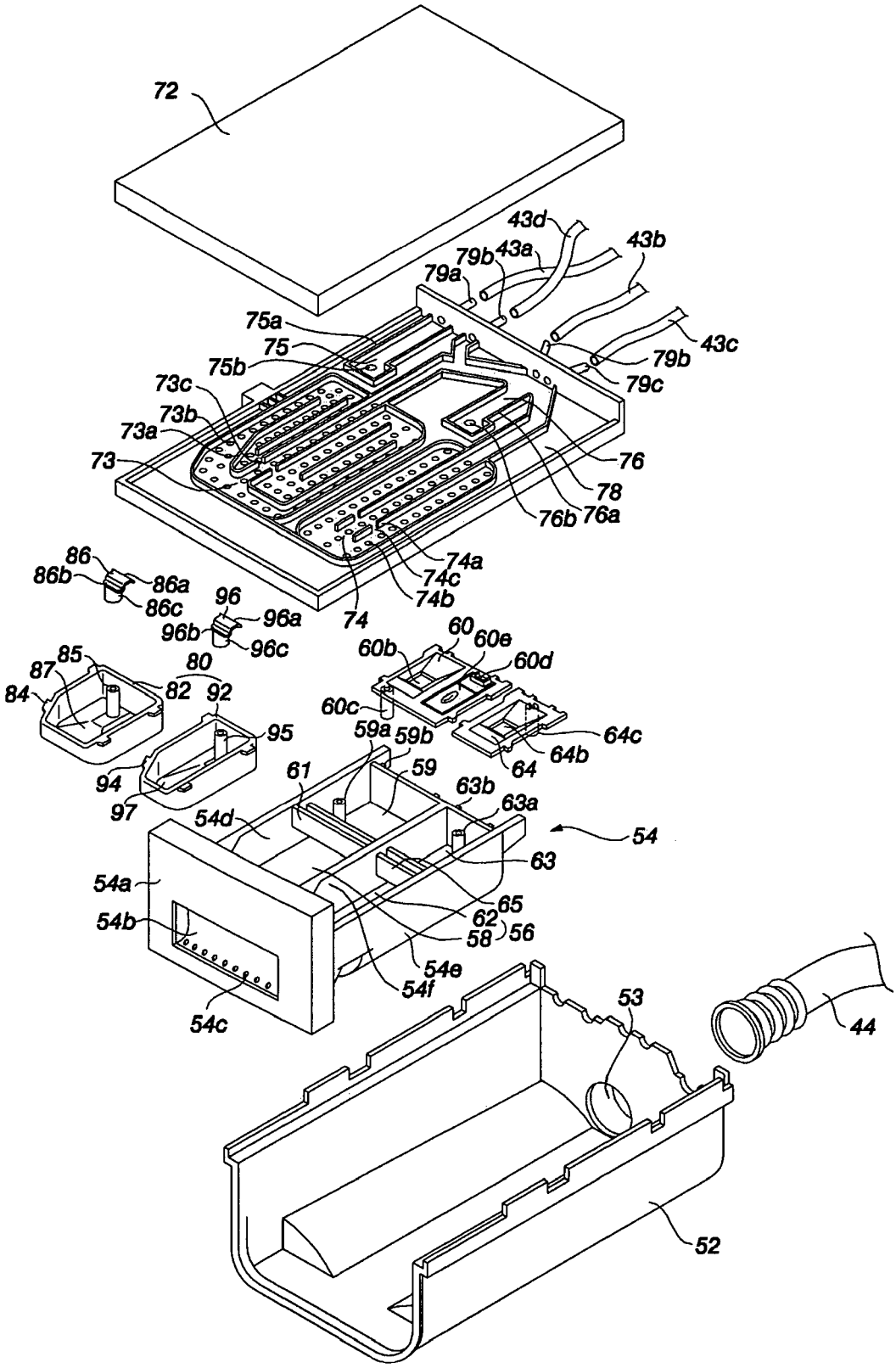
FIG. 3 is an exploded plan of the detergent supply apparatus in FIGS. 1 and 2.
Figure 4:
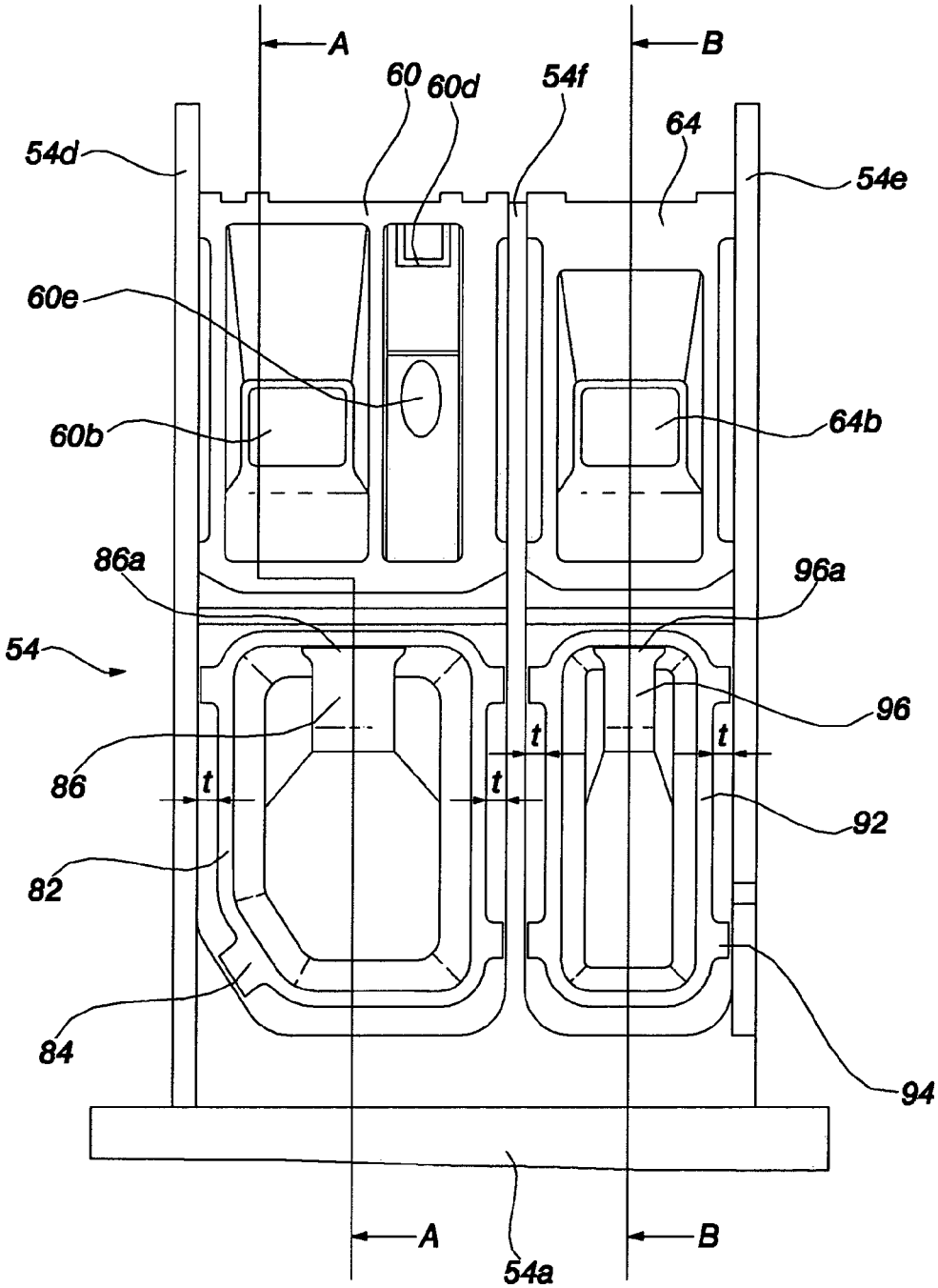
FIG. 4 is a plane plan of the detergent supply apparatus in FIGS. 1 and 2.
Figure 5:
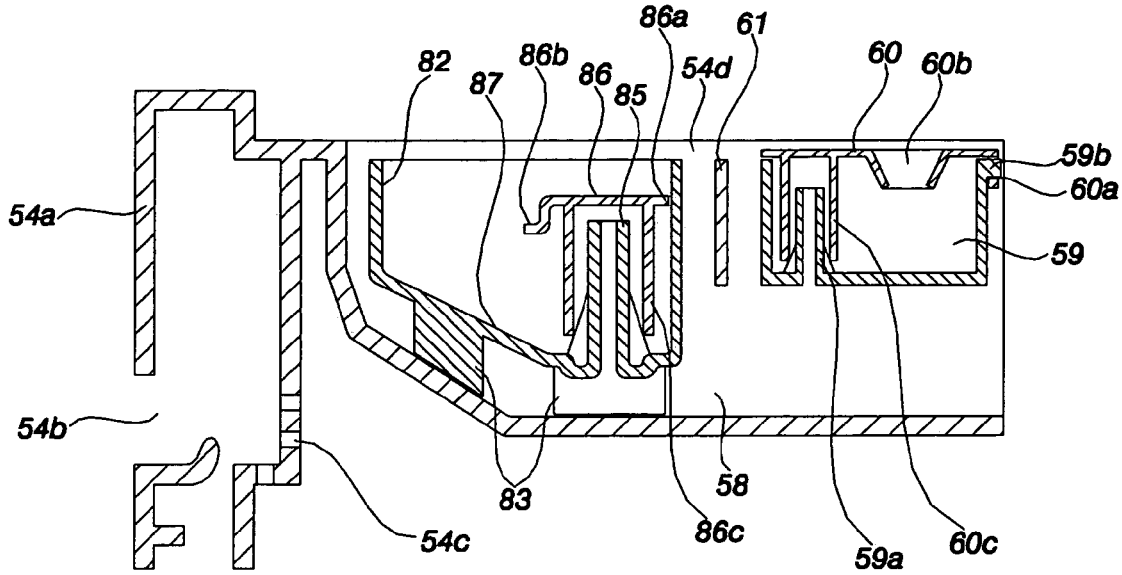
FIG. 5 is a sectional plan of the line A-A in FIG. 4.

FIG. 3 is an exploded plan of the detergent supply apparatus in FIGS. 1 and 2, and FIG. 4 is a plane plan of the detergent supply apparatus in FIGS. 1 and 2. FIG. 5 is a sectional plan of the line A-A in FIG. 4, and FIG. 6 is a sectional plan of the line B-B in FIG. 4.

Figure 6:
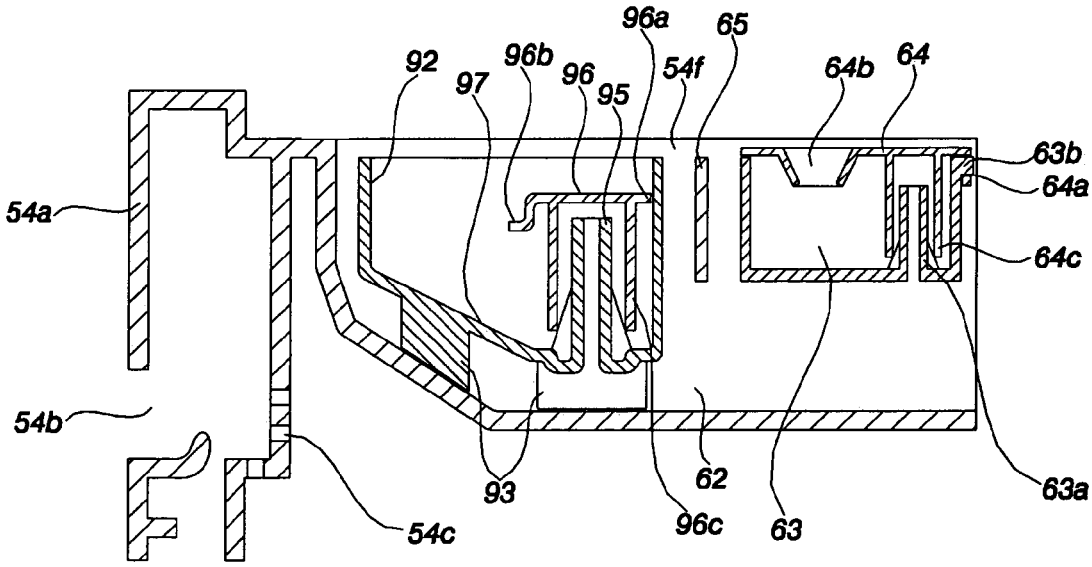
FIG. 6 is a sectional plan of the line B-B in FIG. 4.

As illustrated in FIG. 3 or 6, an outlet 53 is formed on the housing 52, where water and detergent dropped from the detergent container 54 is discharged into the water supply bellows tube 44.

A handle hole 54*b* is formed on a front portion 54*a* of the detergent container 54, which is open at its rear and top.

A ventilation hole 54*c* is formed at a back of the handle hole 54*b* so as to inflow external air in the housing 52.

The detergent container 54 has a powdered detergent chamber 56 to mix and supply powdered detergent and water.

A partition wall 54*f* is formed in the detergent container 54, dividing the powdered detergent chamber 56 to include a main detergent storing section 58 and a preliminary detergent storing section 62, which is separated from both sidewalls 54*d*, 54*e* of the detergent container 54 by predetermined distance.

The detergent container 54 has a bleach storing section 59 where bleach is accommodated and a siphon 59*a* is protruded.

As shown in FIGS. 3 and 5, the bleach storing section 59 is positioned in a rear and top of the main detergent storing section 58. Its bottom is distant from the corresponding area of the main detergent storing section 58 by predetermined distance, which is open at its top.

A bleach cover 60 is provided with the siphon 59*a* and a water drain passage in the bleach storing section 59.

The bleach cover 60 is enough to cover a top surface of the bleach storing section 59, a hook hole 60*a* suspended in a hook 59*b* and a bleach input hole 60*b* for placing bleach are formed therein.

A bottom of the bleach cover 60 has a bleach siphon 60*c* that bleach and water moves upward at an interval with the siphon 59*a*, apart from the siphon 59*a* by predetermined distance.

The bleach cover 60 has a hanging protrusion 60*d* suspended in the control panel 7 or the dispenser 70 when the detergent container 54 is pulled forward, and an elastic portion 60*e* which enables to push by lowering the hanging protrusion not to make the hanging protrusion 60*d* suspended in the control panel 7 or the dispenser 70.

A main detergent clogging-protection rib 61 is formed in the detergent container 54 so as to prevent a bottom of the bleach storing section 59 from clogging, apart from a front of the bleach storing section 59 and from a bottom of the main detergent storing section 58 by predetermined distance.

The detergent container 54 has a fabric softner storing section 63 where fabric softner is accommodated and a siphon 63*a* is protruded.

As shown in FIGS. 3 and 6, the fabric softner storing section 63 is positioned in a rear and top of the preliminary detergent storing section 62. Its lower portion is distant from the corresponding area of the preliminary detergent storing section 62 by predetermined distance, which is open at its top.

A fabric softner cover 64 is enough to cover a top surface of the fabric softner storing section 63, a hook hole 64*a* suspended in a hook 63*b* and a fabric softner input hole 64*b* for placing fabric softner are formed therein.

A bottom of the fabric softner cover 64 has a fabric softner siphon 64*c* that fabric softner and water moves upward at an interval with the siphon 63*a*, apart from the siphon 63*a* by predetermined distance.

A preliminary detergent clogging-protection rib 65 is formed in the preliminary detergent storing section 62 so as to prevent a bottom of the fabric softner storing section 63 from clogging, apart from a front of the fabric softner storing section 63 and from a bottom of the preliminary detergent storing section 62 by predetermined distance.

The dispenser 70, as illustrated in FIG. 3, comprises an upside panel 72 and a downside panel 78 having a main detergent water supply passage 73, a preliminary detergent water supply passage 74, a bleach water supply passage 75, and a fabric softner water supply passage 76.

In one end either of the upside panel 72 or the downside panel 78, a main detergent water supply rib 73*a* for the main detergent water supply passage 73, a preliminary detergent water supply rib 74*a* for the preliminary detergent water supply passage 74, a bleach water supply rib 75*a* for the bleach water supply passage 75, and a fabric softner water supply rib 76*a* for the fabric softner water supply passage 76 are located.

The downside panel 72 has a plurality of main detergent water supply holes 73*b* in a front and top of the main detergent storing section 58, a plurality of preliminary detergent water supply holes 74*b* in a front and top of the preliminary detergent storing section 62, a plurality of bleach water supply holes 75*b* in a front and top of the bleach storing section 59, and a plurality of fabric softner water supply holes 76*b* in a front and top of the fabric softner storing section 63.

The main detergent water supply rib 73*a* has a bypass hole 73*c* to make some water through the main detergent water supply passage 73 detoured to a front of the main detergent water supply holes 73*b*.

The preliminary detergent water supply rib 74*a* has a bypass hole 74*c* to make some water through the preliminary detergent water supply passage 74 detoured to a front of the preliminary detergent water supply holes 74*b*.

The upside panel 72 and the downside panel 78 are assembled by melting bond.

In one end either of the upside panel 72 or the downside panel 78, there are a $1^{st}$ hose connection 79*a* connected to the $1^{st}$ cold water hose 43*a* in order to supply cold water to the bleach water supply passage 75, and a $2^{nd}$, $3^{rd}$, $4^{th}$ hose connection 79*b*, 79*c*, 79*d* connected to the $2^{nd}$, $3^{rd}$ cold water hose 43*b*, 43*c* and the hot water hose 43*d* to optionally supply cold water or hot water to the main detergent water supply passage 73, the preliminary detergent water supply passage 74, and the fabric softner water supply passage 76.

The liquid detergent container 80, as referring to FIGS. 3 or 6, is possible to furnish with both a main liquid detergent container 82 detachably set in the main detergent storing section 58 and a subsidiary liquid detergent container 92 detachably set in the preliminary detergent storing section 62. Or, it is possible to furnish with either the liquid detergent container 82 detachably set in the main detergent storing section 58, or the liquid detergent container 92 detachably set in the preliminary detergent storing section 62.

The main liquid detergent container 82, as referring to FIG. 5, is inserted into a front of the main detergent storing section 58. Its height is lower than that of the main detergent storing section 58 when installed.

The subsidiary liquid detergent container 92, as referring to FIG. 6, is inserted into a front of the preliminary detergent storing section 62. Its height is lower than that of the preliminary detergent storing section 62 when installed.

The liquid detergent container 82, 92, as referring to FIGS. 5 and 6, comprises a plurality of protrusions 83, 93 on a bottom of the powdered detergent chamber 56 to separate from the bottom of the powdered detergent chamber 56 by predetermined distance.

As illustrated in FIGS. 3 and 4, the width of the liquid detergent container 82, 92 is narrower than that of a sidewall 54*d*, 54*e*, 54*f* of the powdered detergent chamber 56. Thus, there is a slit(t) between the sidewall 54*d*, 54*e*, 54*f* of the powdered detergent chamber 56 and that of the liquid detergent container. A plurality of protrusions 84, 94 is existed to separate from the sidewalls 54*d*, 54*e*, 54*f* of the powdered detergent chamber 56 by predetermined distance.

Since overflowed water from the liquid detergent container 82, 92 is drained through the slit(t), it does not flow to another place.

The liquid detergent container 82, 92 has a protruded siphon 85, 95 and a liquid detergent siphon cover 86, 96 which covers the siphon 85, 95 and provides the water drain passage together with the siphon.

The liquid detergent container 82, 92 has a downward sloping surface 87, 97 toward the siphon 85, 95 in a lower part.

The liquid detergent siphon cover 86, 96 has a straight portion 86*a*, 96*a* which is suspended on a wall of the liquid detergent container 82, 92 so as to restrict its rotation.

The liquid detergent siphon cover 86, 96 has an indication portion 86*b*, 96*b* in a stepwise manner, which shows the maximum quantity of liquid detergent.

The liquid detergent siphon cover 86, 96 has a liquid detergent siphon 86*c*, 96*c* where liquid detergent and water moves upward at an interval with the siphon 85, 95, apart from the siphon 85, 95 by predetermined distance.

The process for the present invention will be described below.

Supposing that liquid detergent is used for the preliminary and main washing process, first, the main liquid detergent container 82 is inserted into the main detergent storing section 58 and the subsidiary liquid detergent container 92 is inserted into the preliminary detergent storing section 62, then, liquid detergent is poured into the main liquid detergent container 82 and the subsidiary liquid detergent container 92.

Laundry(m) is received in the drum 20, the door 5*b* is closed, and the control panel 7 orders the washing machine to operate. The washing machine checks a washing mode and makes water supply started.

At least one of the water supply valves 42 supplies water supplied through the external hose 41 to the preliminary detergent water supply passage 74 within the dispenser 70. Water falls toward the front of the preliminary detergent storing section 62 through the preliminary detergent water supply holes 74*b*.

The water supply valve 42 operated to supply water to the preliminary detergent water supply passage 74 allows water to pass intermittently in order to prevent liquid detergent or water from overflowing in case that excessive water is supplied to the subsidiary liquid detergent container 92.

That is, the water supply valve 42 operated to supply water to the preliminary detergent water supply 74 becomes on for the $1^{st}$ setting time, and becomes off for the $2^{nd}$ setting time. Such on and off is repeated.

The $1^{st}$ setting time and the $2^{nd}$ setting time are advisable to set depending on a capacity of the subsidiary liquid detergent container 92.

Water fallen toward the front of the preliminary detergent storing section 62 is contained in the subsidiary liquid detergent container 92 and mixed with liquid detergent which has been put therein.

Mixed liquid detergent and water, as illustrated in FIG. 6, ascends between the siphon 95 of the subsidiary liquid detergent container 92 and the liquid detergent siphon 96*c* of the liquid detergent siphon cover 96, and descends through the siphon 95 of the subsidiary liquid detergent container 92, then, falls toward the bottom of the preliminary detergent storing section 62.

Liquid detergent and water fallen toward the bottom of the preliminary detergent storing section 62 moves to a back of the preliminary detergent storing section 62, subsequently to the housing 52. After going through the outlet 53 of the housing 52, the water supply bellow tube 44 in turn and getting to the tub 10, preliminary washing is operated when the drum 20 rotates by the driving motor 30.

When preliminary washing is completed and main washing is started, at least one of the water supply valves 42 supplies water supplied through the external hose 41 to the main detergent water supply passage 73 within the dispenser 70. Water falls toward the front of the main detergent storing section 58 through the main detergent water supply holes 73*b*.

The water supply valve 42 operated to supply water to the main detergent water supply passage 73 allows water to pass intermittently in order to prevent liquid detergent or water from overflowing like preliminary washing.

That is, the water supply valve 42 operated to supply water to the main detergent water supply 73 becomes on for the $3^{rd}$ setting time, and becomes off for the $4^{th}$ setting time. Such on and off is repeated.

The $3^{rd}$ setting time and the $4^{th}$ setting time are advisable to set depending on the capacity of the main liquid detergent container 82.

Water fallen toward the front of the main detergent storing section 58 is contained in the main liquid detergent container 82 and mixed with liquid detergent which has been put therein.

Mixed liquid detergent and water, as illustrated in FIG. 5, ascends between the siphon 85 of the main liquid detergent container 82 and the liquid detergent siphon 86*c* of the liquid detergent siphon cover 86, and descends through the siphon 85 of the main liquid detergent container 82, then, falls toward the bottom of the main detergent storing section 58.

Liquid detergent and water fallen toward the bottom of the main detergent storing section 58 moves to a back of the main detergent storing section 58, subsequently to the housing 52. After getting to the tub 10 like preliminary washing, main washing is operated when the drum 20 rotates by the driving motor 30.

The washing machine operates main washing and drains contaminated water out of the washing machine. The next operation is performed according to an option for rinsing or dehydrating.

When rinse is chosen, the water supply valve 42 is turned on and clean water is supplied. Clean water, in the same manner as the above washing, passes within the dispenser 70 and falls toward the main liquid detergent container 82 or the subsidiary liquid detergent container 92. It moves to the back of the main detergent storing section 58 or the preliminary detergent storing section 62, subsequently to the housing 52.

Water moved to the housing 52 is supplied to the tub 10 and rinses laundry when drum 20 rotates by the driving motor 30.

The washing machine operates main washing and drains contaminated water out of the washing machine. It repeats water supply, rinse and drain according to the setting frequency.

Then, when dehydration is chosen, the drum 20 rotates with high speed by the driving motor 30 and moisture left in laundry(m) is dehydrated.

Supposing that bleach is used for washing, bleach is poured into the bleach storing section 59 and the washing machine is operated. At least one of the water supply valves 42 supplies water supplied through the external hose 41 to the bleach water supply passage 75 within the dispenser 70. Water falls toward the back of the main detergent storing section 58 through the bleach water supply holes 75*b*.

The water supply valve 42 operated to supply water to the bleach water supply passage 75 allows water to pass intermittently in order to prevent bleach or water from overflowing like preliminary washing or main washing.

That is, the water supply valve 42 operated to supply water to the bleach water supply passage 75 becomes on for the $5^{th}$ setting time, and becomes off for the $6^{th}$ setting time. Such on and off is repeated.

The $5^{th}$ setting time and the $6^{th}$ setting time are advisable to set depending on the capacity of the bleach storing section 59.

Water fallen toward the back of the main detergent storing section 58 is contained in the bleach storing section 59 and mixed with bleach which has been put therein.

Mixed bleach and water ascends between the siphon 59*a* of the bleach storing section 59 and the bleach siphon 60*c* of the bleach cover 60, and descents through the siphon 59*a* of the bleach storing section 59, then, falls toward the bottom of the main detergent storing section 58. Fallen bleach and water is supplied for the tub 10 like preliminary washing and main washing. With that, it improves washing power.

Supposing that fabric softner is used for the rinsing process, fabric softner is poured in the fabric softner storing section 63 and the washing machine is operated. The washing machine rinses more than once and fabric softner is supplied together with water in the last rinsing stage.

Before the last rinse, at least one of the water supply valves 42 supplies water supplied through the external hose 41 to the fabric softner water supply passage 76 within the dispenser 70. Water falls toward the back of the preliminary detergent storing section 62 through the fabric softner water supply holes 76*b*.

The water supply valve 42 operated to supply water to the fabric softner water supply passage 76 allows water to pass intermittently in order to prevent fabric softner or water from overflowing like preliminary washing or main washing.

That is, the water supply valve 42 operated to supply water to the fabric softner water supply passage 76 becomes on for the $7^{th}$ setting time, and becomes off for the $8^{th}$ setting time. Such on and off is repeated.

The $7^{th}$ setting time and the $8^{th}$ setting time are advisable to set depending on the capacity of the fabric softner storing section 63.

Water fallen toward the back of the preliminary detergent storing section 62 is contained in the fabric softner storing section 63 and mixed with fabric softner which has been put therein.

Mixed fabric softner and water ascends between the siphon 63*a* of the fabric softner storing section 63 and the fabric softner siphon 64*c* of the fabric softner cover 64, and descends through the siphon 63*a* of the fabric softner storing section 63, then, falls toward the bottom of the preliminary detergent storing section 62. Fallen fabric softner and water is supplied to the tub 10 like preliminary washing and main washing. With that, it helps laundry(m) more softened.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

For example, the case that the liquid detergent container is inserted into either the main detergent storing section 58 or the preliminary detergent storing section 62 should be interpreted as the claim to the present invention.

As described above, a liquid detergent container in accordance with a detergent supply apparatus of a washing machine is installed in a powdered detergent chamber of a detergent container, which mixes and supplies liquid detergent and water together. Supply of liquid detergent is simple. Liquid detergent diluted with water soaks laundry, therefore, decoloration and discoloration of laundry can be protected.

The liquid detergent container is detachably set in the powdered detergent chamber of the detergent container, therefore, liquid detergent or powdered detergent can be easily put in depending on a user's intention The detergent container has the powdered detergent chambers and the liquid detergent container is detachably set in one of the powdered detergent chambers, therefore, liquid detergent and powdered detergent can be used together.

The powdered detergent chamber is divided into a main detergent storing section and a preliminary detergent storing section. The liquid detergent container includes a main liquid detergent container detachably set in the main detergent storing section and a subsidiary liquid detergent container detachably set in the preliminary detergent storing section. If either the main liquid detergent container or the subsidiary liquid detergent container is installed in the detergent container, a different type of detergent can be used in main washing and preliminary washing. Therefore, the washing power can be much more improved.

A bottom of the liquid detergent container is parted from that of the powdered detergent chamber by predetermined distance, therefore, liquid detergent and water can easily flow without stagnating.

A side of the liquid detergent container is parted from that of the powdered detergent chamber by predetermined distance and a top of the liquid detergent container is lower than that of the powdered detergent chamber, therefore, liquid detergent and water does not overflow into another place. It can prevent the unnecessary use of detergent.

The liquid detergent container has a protruded siphon and a liquid detergent siphon cover which covers the siphon and provides a water drain passage together with the siphon, therefore, mixing and supplying liquid detergent and water is simply possible.

The bottom of the liquid detergent container has a downward sloping surface toward the siphon, therefore, remaining liquid detergent can be minimized.

The liquid detergent siphon cover has a straight portion which is suspended on a wall of the liquid detergent container in order to restrict its rotation, therefore, an additional structure, i.e. a hook, fixing the liquid detergent siphon cover is not required and noise from the vibration of the washing machine can be minimized.

The liquid detergent siphon cover has an indication portion in a stepwise manner, which shows the maximum quantity of liquid detergent, therefore, the user can easily notice the maximum quantity of liquid detergent. It can prevent the excessive use of liquid detergent, even the overflowing of liquid detergent.

What is claimed is:

1. A washing machine, comprising:

a cabinet;

a tub installed in the cabinet;

a drum rotatably set in the tub;

a housing installed in the cabinet;

a detergent box including a powdered detergent container, said detergent box inserted into the housing;

a controllable water supply; and a dispenser having a water supply passage connected to the controllable water supply and having water supply holes configured to supply water into the detergent box, said dispenser covering a top surface of the housing, wherein at least one liquid detergent box is detachably provided in the powdered detergent container, wherein detergent box is configured to be slidably inserted from a front face of the washing machine to a position in the housing under the water supply holes of the dispenser, and wherein a plurality of side protrusions are formed at an upper portion of at least one side wall of the liquid detergent box such that an opening, through which water overflowed from the liquid detergent box passes downward, is formed between the side wall of the liquid detergent box and a side wall of the detergent box.

2. The apparatus of claim 1, wherein the powdered detergent container is partitioned into a main detergent container and a preliminary detergent container, the main and preliminary detergent containers arranged side-by-side in a direction orthogonal to the detergent box insertion direction, wherein the at least one liquid detergent box includes a first liquid detergent box detachably provided in the main detergent container, and a second liquid detergent box detachably provided in the preliminary detergent container, the second liquid detergent box being smaller than the first liquid detergent box.

3. The apparatus of claim 2, further comprising:

a first and second internal liquid detergent siphon tube projected within the first and second liquid detergent boxes, respectively; and a first and second liquid detergent siphon cover connected to the first and second internal liquid detergent siphon tubes, respectively, and provided over the respective first and second liquid detergent boxes.

4. The apparatus of claim 3, wherein each of the first and second liquid detergent siphon covers comprises:

a corresponding external liquid detergent siphon tube aligned with the corresponding internal liquid detergent siphon tube, a corresponding display part configured to display an input quantity of liquid detergent, and a corresponding straight part configured to restrict a rotation of the corresponding liquid detergent siphon cover.

5. The apparatus of claim 3, wherein an upper end of each of the first and second liquid detergent boxes is set lower than an upper end of the powdered detergent container.

6. The apparatus of claim 5, wherein a bottom of each of the first and second liquid detergent boxes is inclined downward at a predetermined angle toward the corresponding internal liquid detergent siphon tube.

7. The apparatus of claim 3, wherein each of the first and second liquid detergent boxes further comprises:

a corresponding bottom projection separating a bottom of the powdered detergent container and a bottom of the corresponding liquid detergent box.

8. The apparatus of claim 7, each bottom projection comprising:

a tip confronting the bottom of the powdered detergent container tilted at a predetermined angle.

9. The apparatus of claim 7, wherein each of the first and second liquid detergent boxes further comprises:

a lateral side projection separating a sidewall of the powdered detergent container and a lateral side of the liquid detergent box.

10. The apparatus of claim 2, further comprising:

a bleach container behind the powdered detergent container in the apparatus insertion direction, the bleach container configured to leave a gap from a bottom of the powdered detergent container, the bleach container configured to operate in conjunction with the controllable water supply to supply a bleach and water, the controllable water supply being a multi-chamber water supply, the bleach container configured to be positioned under a bleach portion of the multi-chamber water supply when the apparatus is installed in the washing machine.

11. The apparatus of claim 10, further comprising:

a bleach siphon tube provided within the bleach container;

a first hook provided on an outside portion of the bleach container; and a bleach siphon cover having an external bleach siphon tube aligned with the bleach siphon tube and a first hook hole confronting the first hook provided over the bleach container.

12. The apparatus of claim 11, further comprising:

a first supply hole provided in the bleach siphon cover and configured to allow the bleach and/or water to pass through.

13. The apparatus of claim 10, further comprising:

a softening agent container behind the powdered detergent container in the apparatus insertion direction, the bleach container configured to leave a predetermined gap from a bottom of the powdered detergent container, the softening agent container configured to operate in conjunction with the controllable water supply to supply a softening agent and water, the softening agent container configured to be positioned under a softening agent portion of the multi-chamber water supply when the apparatus is installed in the washing machine.

14. The apparatus of claim 13, further comprising:

a softening agent siphon tube provided within the softening agent container;

a second hook provided on an outside portion of the softening agent container; and a softening agent siphon cover provided over the softening agent container and having an external softening agent siphon tube aligned with the softening agent siphon tube and a second hook hole confronting the second hook.

15. The apparatus of claim 14, further comprising:

a second supply hole provided in the softening agent siphon cover and configured to allow the softening agent and/or water to pass through.

* * * * *